United States Patent [19]

Evans

[11] Patent Number: 4,613,836

[45] Date of Patent: Sep. 23, 1986

[54] DEVICE FOR SWITCHING BETWEEN LINEAR AND CIRCULAR POLARIZATION USING ROTATION IN AN AXIS ACROSS A SQUARE WAVEGUIDE

[75] Inventor: Gary E. Evans, Trappe, Md.

[73] Assignee: Westinghouse Electric Corp., Pittsburgh, Pa.

[21] Appl. No.: 797,334

[22] Filed: Nov. 12, 1985

[51] Int. Cl.[4] ..... H01P 1/18; H01P 1/17

[52] U.S. Cl. ..... 333/159; 333/21 A; 333/157; 333/251

[58] Field of Search ..... 333/157–159, 333/21 R, 21 A, 248, 251, 259, 263; 343/756, 783, 786; 332/16 R, 23 R, 29 R

[56] References Cited

U.S. PATENT DOCUMENTS

| | | | |
|---|---|---|---|
| 2,840,820 | 6/1958 | Southworth | 333/108 X |
| 2,858,512 | 10/1958 | Barnett | 333/159 |
| 3,024,463 | 3/1962 | Moeller et al. | 343/783 |
| 3,216,017 | 11/1965 | Moore | 343/756 |
| 3,622,921 | 11/1971 | Heeren | 333/248 X |
| 3,668,567 | 6/1972 | Rosen | 333/117 X |
| 4,060,781 | 11/1977 | Hudspeth et al. | 333/259 |
| 4,222,017 | 9/1980 | Foldes | 333/21 R X |
| 4,353,041 | 10/1982 | Bryans et al. | 333/21 A |
| 4,375,052 | 2/1983 | Anderson | 333/21 A |
| 4,414,516 | 11/1983 | Howard | 333/21 A |
| 4,420,729 | 12/1983 | Ashforth | 333/159 |

*Primary Examiner*—Marvin L. Nussbaum
*Attorney, Agent, or Firm*—W. G. Sutcliff

[57] ABSTRACT

A microwave phase shifting device utilizing the rotation lateral to a longitudinal axis across a square or circular waveguide by a slab of dielectric material to provide a differential phase shift between a linear to circular polarization in a high frequency microwave signal.

8 Claims, 14 Drawing Figures

DEVICE FOR SWITCHING BETWEEN LINEAR AND CIRCULAR POLARIZATION USING ROTATION IN AN AXIS ACROSS A SQUARE WAVEGUIDE

BACKGROUND OF THE INVENTION

1. Field of the Invention

The present invention relates to an apparatus which uses the rotation in an axis across a square or round waveguide of a slab of dielectric material of predetermined dielectric coefficient and shape to provide a means of changing the differential phase shift between the orthogonal fields in the waveguide, as might be used to switch between linear and circular polarization in a high frequency microwave.

2. Description of the Prior Art

It is often necessary to provide a means of switching between linear and circular polarization or between polarization senses of a microwave signal as propagated by a conventional waveguide. A mechanism is required which adds a differential phase shift to one linear polarization compared to the orthogonal field.

FIG. 1 is a conventional rectangular waveguide. A waveguide is typically a metal fabrication having a top, bottom, two sides in a rectangular format which is operable to transmit high frequency microwave energy. Conventional waveguides can also be of the circular nature; and FIG. 2 is an example of a circular waveguide. It too is operable to transmit high frequency microwave energy.

In order to provide a differential phase shift it is well known in the prior art to utilize a slab of dielectric material within the waveguide rotatable about the guide's longitudinal axis, round or circular, to provide a differential phase shift for the microwave signal.

Mechanical switching as described above has been done in any one of the following methods: movement of a dielectric slab laterally to the waveguide with a linear actuator and guide pins; rotation of the entire phasing section utilizing choke joints on each end of the phasing section; rotation of a longitudinal slab of dielectric about the waveguide axis using a circular waveguide as a bearing and with a gear teeth on the dielectric; or rotation of the dielectric in a circular waveguide by extending a dielectric rod through to a waveguide bend. These mechanical switching techniques as described are very complex techniques which require relatively easy access to the rotational mechanisms involved.

SUMMARY OF THE INVENTION

The microwave phase shifting device of the present invention comprises a microwave waveguide with a dielectric member disposed within the waveguide to effect the desired phase shift. The dielectric member is rotatable about an axis which is transverse to the waveguide longitudinal axis.

Most microwave polarizers that utilize mechanical motion to change the output polarization of the high frequency microwave signal involve a dielectric or metallic vane located within the waveguide that rotates about the longitudinal axis of the waveguide. The proposed devices as embodied in this invention retains the convenience of rotational motion but rotates laterally within the waveguide which no previous microwave polarizer has achieved. It thereby avoids having an axial joint or an axial drive rod within the radio frequency power transmission line. Thus the circumferential joints and bearings are eliminated. It is not easy to get an axial rotation without disturbing the field as evidenced by many special joint seals and transitions previously used. The lateral axes used in this application, however, has not been used because the moving vane or dielectric is not a simple item to design. In its most elementary form of a rectangular slab of dielectric material the differential phase shift is small and the slab has different reflections in each position and for each field. However a "Z" shape, which requires considerable experimentation to achieve performance in both physical positions can be also found. Having been achieved utilizing the "Z" shape, the assembly is simple and easy to utilize.

BRIEF DESCRIPTION OF THE DRAWINGS

For a better understanding of the invention reference may be had of the preferred embodiment exemplary of the invention shown in the accompanying drawings in which.

DESCRIPTION OF THE PREFERRED EMBODIMENT

Figure 1:
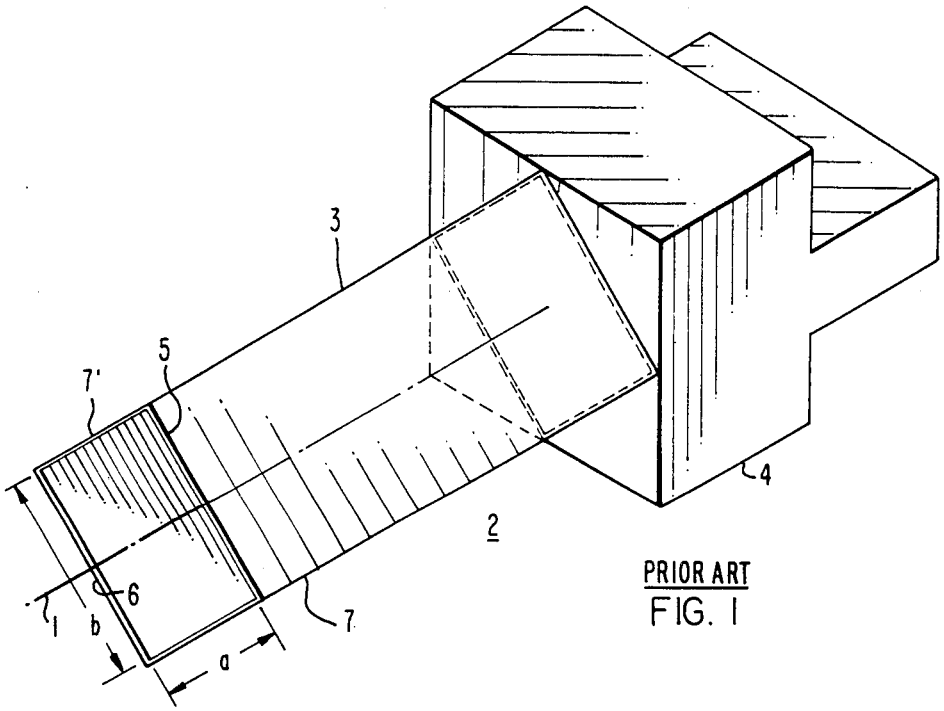
PRIOR ART FIG. 1
FIG. 1 is an isometric of a rectangular waveguide assembly.

FIG. 1 shows a prior art rectangular waveguide assembly 2 which comprises a rectangular waveguide 3 interconnected to a microwave generating apparatus 4. The rectangular waveguide 3 further comprises an interconnection of four panels, the top panel 5, bottom panel 6 and side panels 7 and 7'. The top panel 5 and bottom panel 6 are parallel to each other and to the longitudinal axis of the rectangular waveguide 1. The top and bottom panels 5, 6 are equivalent in dimensions and parallel to each other. The two side panels 7 and 7' are also of equivalent dimensions and parallel to each other and to the longitudinal axis 1. The height of the rectangular waveguide is a and the width of the rectangular waveguide is b. Although any transmission system serves a guiding structure for guided waves the term "waveguide" is reserved for those types which consist of a hollow conductor.

The electrical characteristics of the rectangular waveguide shown in FIG. 1 are determined by its height and width dimensions a and b. These are dimensions that will be always taken from the inside measurement of the waveguide, with the smaller of the two dimensions always being taken as the height even though it may lie in a horizontal plane.

Although a rectangular waveguide can carry energy in a variety of ways, there is only one way, the simplest, which is utilized in practice. In that case, linearly polarized electromagnetic waves travel down the waveguide with the electric field parallel to either the sides, or the top and the bottom of the waveguide.

Figure 2:
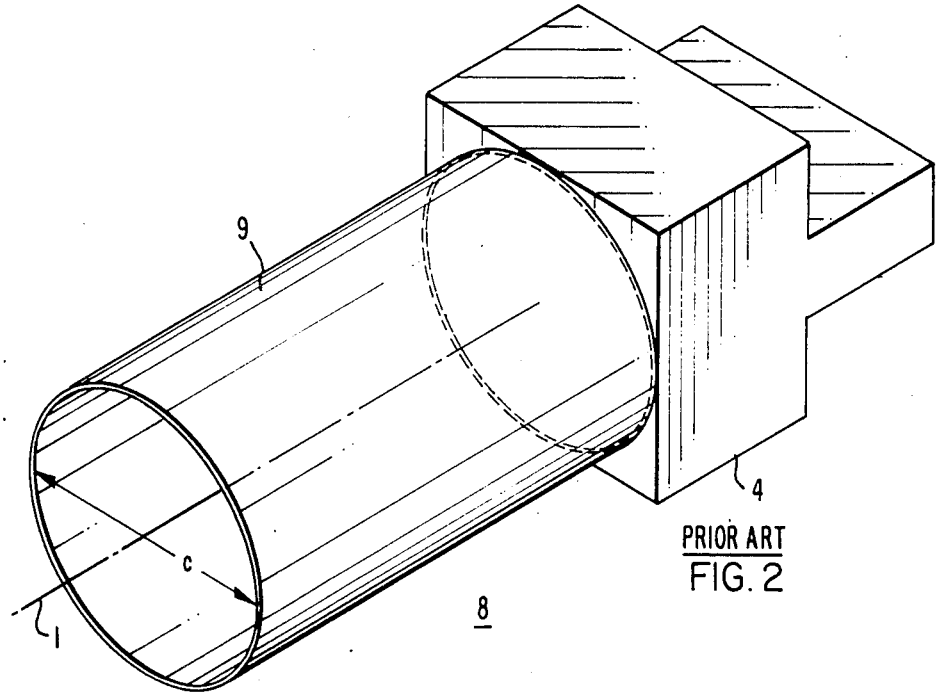
PRIOR ART FIG. 2
FIG. 2 is an isometric of a circular waveguide assembly.

FIG. 2, an example of the prior art, shows the second most common waveguide utilized in the transmission of high frequency microwave energy and that is the circular waveguide. The circular waveguide 8 as shown in FIG. 2, comprises the circular waveguide itself 9 and the microwave generating apparatus 4. It too has a longitudinal axis 1 and the characteristics of the circular waveguide as shown in FIG. 2 are determined by the diameter which is always taken as the inside measurement.

Figure 3:
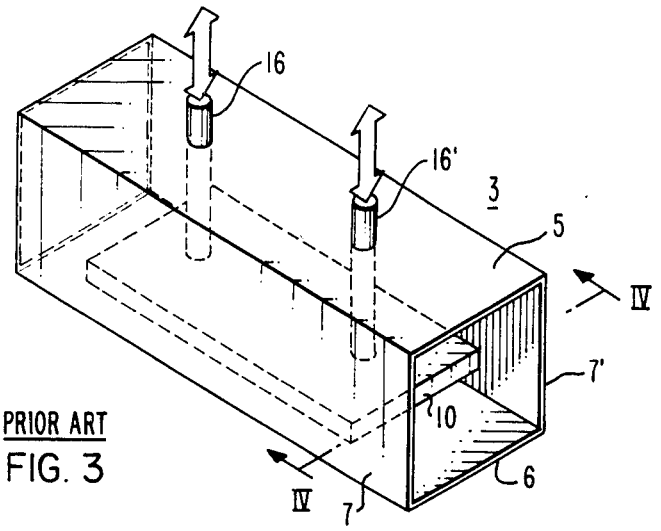
PRIOR ART FIG. 3
FIG. 3 is an isometric of a rectangular waveguide assembly containing a rectangular slab of dielectric material.

FIG. 3 is a lateral dielectric plate 10 as known in the prior art located within the rectangular waveguide 3. The lateral rectangular plate 10 is raised or lowered within the waveguide 3 by the use of two shaft means 16 and 16' which are connected at one face of the lateral dielectric plate 10. This lateral dielectric plate 10 is therefore operable to move in a lateral position within the rectangular waveguide 3 dependent upon the lateral motion of the pins 16 and 16'.

Figure 4:
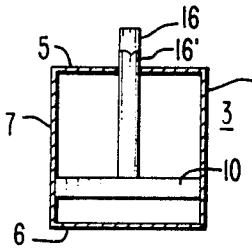
PRIOR ART FIG. 4
FIG. 4 is a cross-section of the isometric rectangular waveguide assembly as in FIG. 3.

The cross-section IV—IV of prior art FIG. 3 as shown in FIG. 4, also well known in the prior art, demonstrates the motion of the dielectric plate 10 within the waveguide means 3. The dielectric plate 10 is in the quarter wave plate circular polarization position, in this FIG. 4. If the quarter wave lateral dielectric plate 10 were raised to its highest position within the waveguide 3 the quarter wave plate 10 would be polarizing the high frequency microwave signal in the vertical or linear polarization mode.

Figure 5A:
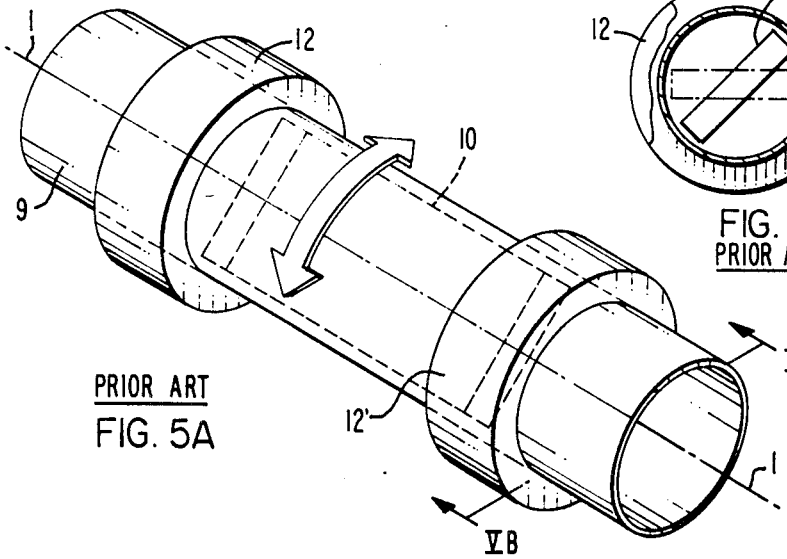
PRIOR ART FIG. 5A
FIG. 5A is an isometric view of a circular waveguide assembly.
Figure 5B:
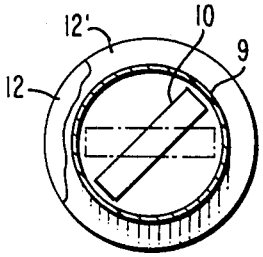
FIG. 5B PRIOR ART
FIG. 5B is a cross-section view of the waveguide assembly of 5A.

FIG. 5, another example of the prior art, is a rotating waveguide of a circular type 9 which rotates about the longitudinal axis 1 of the circular waveguide 9 utilizing choke joints 12 and 12'. The slab of dielectric material 10 which is centered upon the longitudinal axis 1 of the circular waveguide 9 will achieve a differential phase shift by the physical mechanical change in the position of the entire waveguide 9 via the change in position of the choke joints 12 and 12'. FIG. 5B is a cross-section of FIG. 5A showing the change in position of the quarter wave plate 10 after the change in position of the choke joints 12 and 12'. When the quarter wave plate is perpendicular to the wave the resultant polarization is vertical or linear and when the position of the dielectric material 10 is at a 45° angle to the perpendicular the polarization is in the circular mode.

Figure 6A:
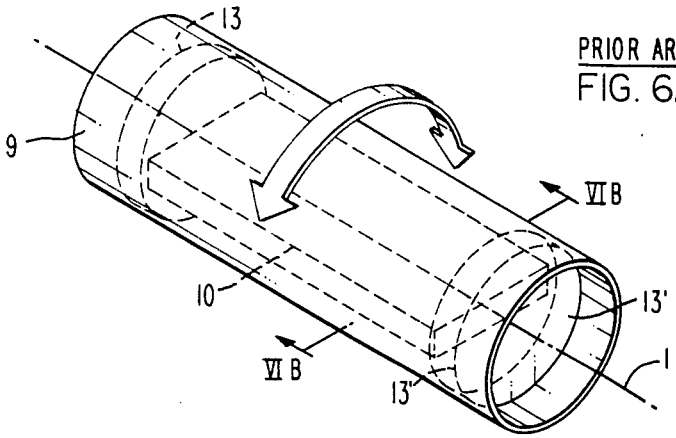
PRIOR ART FIG. 6A
FIG. 6A is an isometric view of a circular waveguide assembly.

FIG. 6A, as prior art, is yet another version of the rotating waveguide. This time the rotating waveguide allows the rotation of the dielectric material 10 by the rotating slab assembly comprising the rotating dielectric slab 10 interconnected to two internal choke flanges 13 and 13'.

Figure 6B:
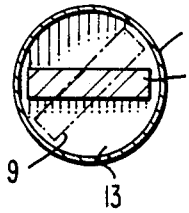
PRIOR ART FIG. 6B
FIG. 6B is a cross-section view of the circular waveguide assembly of 6A.

The dielectric slab 10 and the choke flanges 13 and 13' can be seen in cross-section in FIG. 6B. Again when the dielectric slab material 10 is perpendicular to the wave traveling through the circular waveguide 9 the polarization of the high frequency microwave is in the vertical or linear polarization mode. When the dielectric slab material 10 is at a 45° angle to the wave the polarization is in a circular mode.

Figure 7:
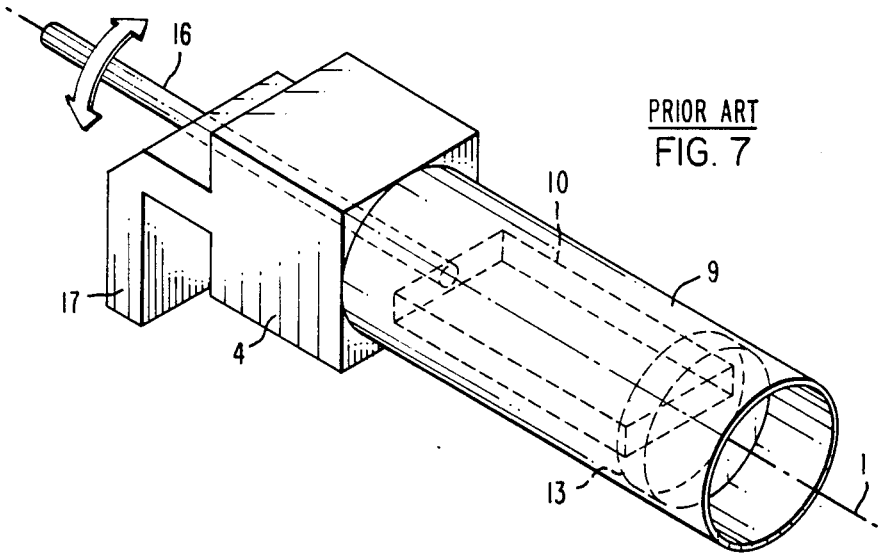
PRIOR ART FIG. 7
FIG. 7 is an isometric view of a circular waveguide assembly.

FIG. 7, shows as well known in the prior art an isometric view of a rod through an added bend waveguide means. The circular waveguide 9 interconnects a microwave generating apparatus 4 and further a rod or shaft means 16 passes through the bend waveguide means 17 through the microwave generating means 4 upon the longitudinal axis 1 and through the dielectric material 10 with a choke flange 13. A change in the position of the shaft means 16 will result in a longitudinal motion of the slab dielectric material 10. This change in the dielectric material 10's location will result in a change not unlike the changes seen in the rotating waveguide or rotating slab assembly discussed in FIG. 6 and FIG. 5, respectively.

All of the previously described waveguides and means to move the dielectric plate 10 within these waveguides whether circular or rectangular in nature has been based upon the longitudinal motion of the dielectric plate about the longitudinal axis of the waveguide. It is the preferred embodiment of this invention which approaches the manipulation of the dielectric plate 10 within the waveguide whether rectangular or circular in a lateral motion about a fixed axis which will pass perpendicular to the longitudinal axis of the waveguide.

Figure 8A:
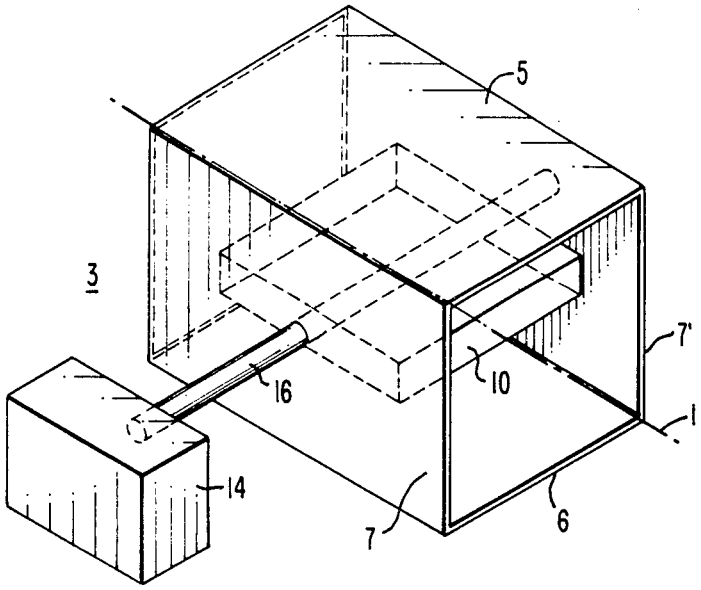
FIG. 8A is an isometric view of the preferred embodiment.

FIG. 8A is a form of the disclosed invention in its most basic mechanism. A rectangular waveguide 3 with a longitudinal axis 1 has a top and bottom panel 5 and 6 respectively and two side panels 7 and 7'. A shaft means 16 passes through the waveguide 3 perpendicular to the longitudinal axes 1 and interconnects the extreme wall 7'. It egresses through wall 7 and the shaft means 16 further interconnects a driving means or what we call a turning means 14. The dielectric plate 10 rests upon this shaft in such a manner that the rotation of the shaft in a clockwise or counterclockwise manner will result in a rotation of the dielectric plate 10. In FIG. 8A we show the position of the plate parallel to the longitudinal axis of the waveguide and in this position the high frequency microwave energy emitted from the waveguide 3 will be circular in nature. The microwave energy is transmitted along the waveguides longitudinal axis.

Figure 8B:
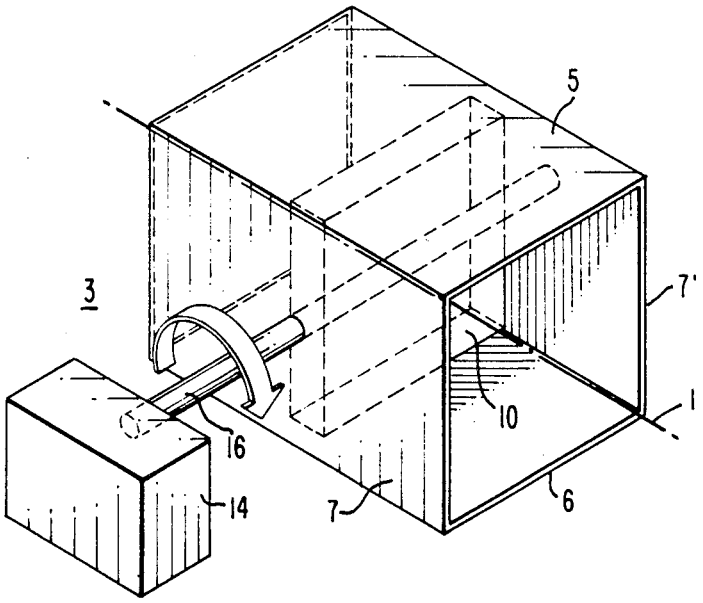
FIG. 8B is an isometric view of the preferred embodiment.

In FIG. 8B, also the invention, we show the repositioning of the plate 10 as a result of the rotation of the shaft means 16 by the turning or rotational means 14 and of course the subsequent change of position of the dielectric 10 into a position perpendicular to the exiting wave and the resultant wave issuing from this waveguide 3 would be of a vertical nature or vertical polarization. This basic mechanism has a mounting via the shaft means 16 which is simple and strong, however two problems would exist utilizing what we refer to as natural dielectrics. The conventional naturally occurring dielectrics used in the dielectric plate 10 would have a dielectric constant of between 2 to 2.5 and this will result in less than 50° phase shift in the polarization of the high frequency wave. Also the length of the dielectric slab 10 would be too short for matching transformers so the length of dielectric and its dielectric constant would be detrimental factors in this extremely basic mechanism. If the use of artificial, man-made, dielectrics were permitted our artificial dielectrics would raise the dielectric constant sufficient to overcome part 1 of this problem, however if the artificial dielectrics cannot be utilized in this engineering situation then an improved geometry is recommended in a second preferred embodiment. This improved geometry of the rectangular slab 10 would result in a dogleg or what we call a "Z" geometry. It would take advantage of the fact that as the slab is rotated most of the effects would occur with only 50° of rotation.

Figure 9:
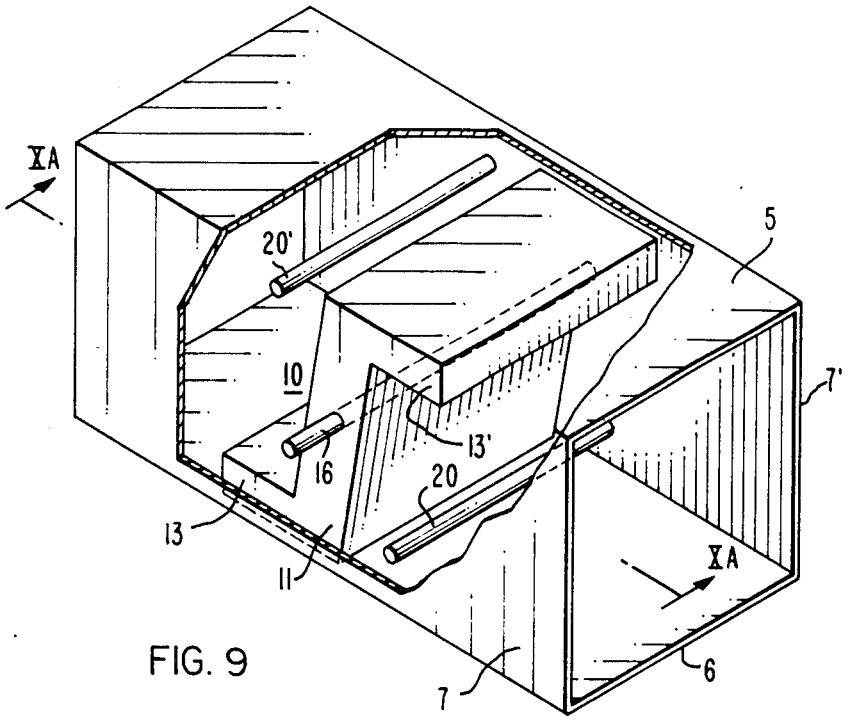
FIG. 9 is an isometric cutout view of possible embodiments.
Figure 10A:
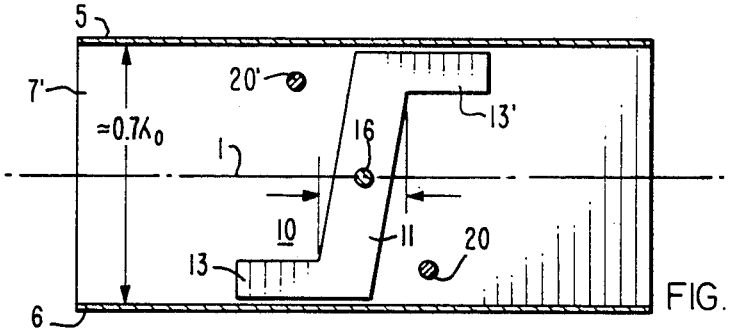
FIG. 10A is an elevational cross-section of the preferred embodiment of FIG. 9.

FIG. 9 is an example of the preferred embodiment utilizing a natural dielectric and this "Z" configuration. Again we have a rectangular waveguide 3 with top bottom panels 5 and 6 respectively and two side panels 7 and 7'. Further, located upon the shaft means 16 we have the dielectric rectangular slab 10, however in this configuration the slab has a central portion 11 and two side portions 13 and 13', respectively. Further, it is well known in the art of waveguide technology that inductive rods can be utilized to equalize the two polarizations by aid in the impedance matching for the field parallel to the broad face of the dielectric, and as also well known the central slab 11 would be one-half of a guide wavelength in the 20° position. These inductive rods 20 and 20' would have negligible effect on the perpendicular field, providing a means of correcting the impedance match of the two fields independently. Experimentally a 90° differential phase shift can be achieved with a dielectric constant low as 2.0 which is sufficient utilizing a natural dielectric. Further, the normal location of these devices in an exposed inaccessible antenna feed system would make it of critical importance to have a compact reliable mechanism utilizing simple bearings and a simple 50° phase rotation of a shaft supported on both ends. As can be seen in FIG. 9 the shaft means 16 passes through first wall 7 into the body of the central dielectric 11 of the dielectric slab 10 and also interconnects at the far wall 7'. During operations the rotation of the shaft means 16 will result in a change in the lateral position of the dielectric slab 11. Crosssection 1010 can be seen in detail in FIGS. 10A and 10B. In FIG. 10A we see the rectangular slab 10 with central section 11 and side sections 13 and 13' as it would rest upon the shaft means 16 and further paralleled by the inductive rods 20 and 20'.

Figure 10B:
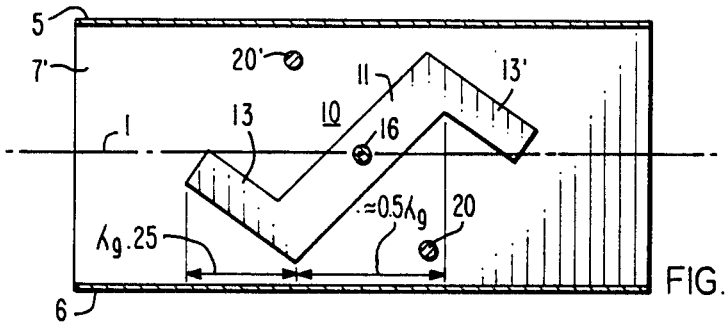
FIG. 10B is a further elevational cross-section of the preferred embodiment of FIG. 9.

As a specific example of the "Z" type of preferred embodiment the dielectric material as shown in FIGS. 10A and 10B would have a dielectric constant of approximately 2.3. This would be as utilized for approximately full size 3 gigahertz working model. The approximate A or A dimension of the waveguide 3 would be approximately 0.7 wavelength. The approximate width of the central section 11 of the dielectric material or rectangular plate 10 would be approximately one-half wavelength while the approximate length of the two end sections 13 and 13' of the dielectric material 10 would be approximately one-quarter wavelength. We do not wish to restrict the use, however, of "Z" dielectric plate means 10 to use within a rectangular waveguide only. The basic mechanism, a slab of rectangular dielectric material rotatable upon a shaft which is perpendicular to the longitudinal axis of the waveguide would be operable within a circular waveguide as well as a rectangular waveguide.

For clarity and explanatory purposes, in this application, reference is made to an embodiment in rectangular waveguide and as a means of switching from linear to circular polarization. It is recognized, however, that the invention is applicable to circular or other crosssections of waveguide, and that other applications derive from the differential phase shifting of the orthogonal field components within such waveguides.

The preferred embodiment of this invention is a rectangular metal waveguide. This waveguide would have a longitudinal axis and be formed from the interconnection of four planar elements. This interconnection would be a top panel, a bottom panel and two side panels interfacing perpendicular one to another. The top and bottom panel would be of equivalent dimensions and parallel to each other about the longitudinal axis and parallel to said axis. The side panels also of equivalent dimensions would also be parallel one to another and also parallel to the longitudinal axis. This waveguide would be of a metal so operable to transmit high frequency microwave signals of either circular or linear polarization. Bisecting perpendicular to the longitudinal axis of the waveguide would be a shaft means. This shaft means of perhaps a cylindrical nature would be of sufficient strength and length to be accessible from outside of the waveguide and to pass directly through the waveguide wall interconnecting to the dielectric slab on one or both sides of the waveguide. It would be parallel to the top and bottom and perpendicular to the two sides of the waveguide. Mounted upon this shaft would be the rectangular slab of dielectric material having a predetermined dielectric constant and a predetermined shape. This slab would be of sufficient length to provide the appropriate degree of rotation and sufficient shift in polarization.

The preferred embodiment of this invention would use a dielectric body having a "Z" or dogleg geometry for maximum differential phase shift and low reflections. This dogleg geometry would take advantage of the fact that the slab as rotated from a position with the legs against the side of the waveguide to a position approximately centered in the waveguide, the effect on a high frequency microwave signal having its electric field essentially perpendicular to the broad face of the dielectric is slight. At the same time the effect on the field component that is parallel to the broad face of the dielectric is large, and can readily cause a phase change of more than 90°. In one embodiment the central slab would be one-half of a guide wavelength in the 20° position to aid the impedance matching and it could be trimmed or compensated for utilizing inductive rods to equalize the two polarizations. These rods as shown in FIG. 9 have negligible effect on the field component that is orthogonal to the broad face of the dielectric. Experimental indications are that a 90° differential phase shift can be achieved with a dielectric constant of as low as 2.0, and a shaft rotation of approximately 50°.

The normal location of these devices would be in exposed inaccessible antenna feed systems where it would be very important to have a compact reliable mechanism of course distinct from the prior art, and this ability to use a simple 50° rotation of a shaft supported on both sides by simple bearing would be a significant advantage over the prior art.

In the preferred embodiment the rectangular slab of the elementary device or the "Z" type dielectric slab of the more complex device utilizing artificial dielectrics would be operable to rest upon the shaft and be able to turn laterally within the waveguide when the shaft is turned by an outside rotational mechanism. This lateral rotation would cause the waveguide to move perpendicular to the longitudinal axis of the waveguide and by this lateral rotation and longitudinal change would cause the differential phase shift of the microwave signal from a linear to a circular polarization. The shaft rotation mechanism located outside the waveguide would be connected to this shaft and it would be able to achieved a clockwise or counterclockwise rotation at the shaft during operation.

Another positive feature of utilization in a lateral rotational mechanism is the necessity of in a pressurized waveguide providing only seals about the rotational waveguide and shaft mechanism as attached to the rectangular dielectric or "Z" dielectric. In the prior art it was necessary to rotate the entire waveguide section containing the dielectric slab. The necessity of utilizing a drive and two choke joints located on opposite sides of the dielectric slab exterior to the waveguide required a significant amount of pressurization and sealing of the equipment. It was also extremely difficult to access and make changes within the waveguide. This new embodiment would require a simple fitting or bushing or O-ring about the shaft which supports the dielectric slab during its lateral rotation operation. It would not require the additional choke joints applied to the exterior of the waveguide and also would not require complex pressurization systems.

Numerous drawings shall be interpreted as illustrative and not in a limiting sense. Variations may be made in the above-described combination and different embodiments of this invention may be made without departing from the spirit thereof. Therefore it is intended that all matter contained in the foregoing description and in the accompanying drawings shall be interpreted as illustrative and not in a limiting sense.

We claim:

1. A microwave phase shifting device comprising:

a metal waveguide means having a longitudinal axis, said waveguide means comprising a hollow elongated conductive enclosure, said waveguide means operable to transmit a high frequency microwave signal of either circular or linear polarization, a shaft means passing through said waveguide wall, said shaft means perpendicular to said longitudinal axis of said waveguide and said shaft means is of sufficient length to be accessible from outside of said waveguide and said shaft means is operable to rotate in a clockwise or counterclockwise direction while extended into said waveguide rotatable about an axis transverse to said longitudinal axis of said waveguide;

a slab of dielectric material having a predetermined dielectric constant and predetermined length, said slab operable to permit said shaft to attach to, and support said slab of dielectric material, said slab further operable to rotate laterally upon said shaft means within said waveguide means perpendicular to said longitudinal axis of said waveguide means and via said lateral rotation of said dielectric slab means achieves a differential phase shift of the orthogonal fields of said microwave signal, and;

a shaft rotation means located outside of said waveguide means connected to said shaft means and operable to achieve the clockwise or counterclockwise rotation of said shaft means and ultimately the lateral rotation of said dielectric means achieving a differential phase shift of said microwave signal.

2. The metal waveguide means as described in claim 1 whereby said waveguide means further comprises the interconnection of a top panel, a bottom panel, and two side panels, said top and said bottom panels of equivalent dimensions; said top and said bottom panels parallel to each other and perpendicular to said side panels, said two side panels are parallel to each other and parallel to said longitudinal axis of said waveguide.

3. A microwave phase shifting device as in claim 1 whereby said rectangular slab of dielectric material having a predetermined dielectric constant further comprises a middle section operable to permit the insertion of said shaft means and two end sections connected to said middle section at predetermined angles forming a "Z" type configuration, said rectangular slab operable to rotate laterally perpendicular said longitudinal axis of said waveguide and via said lateral rotation to achieve a differential phase shift of said high frequency microwave signal.

4. A microwave phase shifting device as described in claim 1 wherein a circular metal waveguide means having longitudinal axis is used operable to transmit a high frequency microwave signal of either circular or linear polarization.

5. A microwave phase shifting device as in claim 1 whereby said rectangular slab of dielectric material has a predetermined dielectric constant of greater than 2.0.

6. A microwave phase shifting device as in claim 1 whereby said lateral rotation of said dielectric means achieving a differential phase shift of said microwave signal from a circular to linear polarization.

7. A microwave phase shifting device, comprising:

an elongated waveguide means having a longitudinal axis along which the microwave signal is propagated;

a dielectric member disposed within the waveguide means and being rotatable about an axis transverse to the longitudinal axis of the waveguide, whereby said dielectric member has a predetermined dielectric constant and predetermined dimension relative to the waveguide cross section and that when said dielectric member is predeterminedly rotated a specific distance transverse to said axis, said microwave signal is phase shifted a predetermined amount.

8. A microwave phase shifting device as in claim 7 whereby said microwave signal is phase shifted from a circular to a linear polarization.

* * * * *